United States Patent [19]

Martinez

[11] 4,324,495

[45] Apr. 13, 1982

[54] FIBER FEEDER PULLEY CLEANING SYSTEM

[75] Inventor: Emilio M. Martinez, Windsor, Colo.

[73] Assignee: Manville Service Corporation, Denver, Colo.

[21] Appl. No.: 171,779

[22] Filed: Jul. 24, 1980

[51] Int. Cl.[3] ..... B01F 7/02

[52] U.S. Cl. ..... 366/271; 198/498; 198/622

[58] Field of Search ..... 366/150, 151, 153, 154, 366/155, 64, 241, 271, 332, 341, 348, 349; 198/498, 622; 15/256.5; 428/220

[56] References Cited

U.S. PATENT DOCUMENTS

| | | | |
|---|---|---|---|
| 2,886,169 | 5/1959 | Calder | 198/498 |
| 3,125,231 | 3/1964 | Mortland | 366/150 |
| 3,222,221 | 12/1965 | Branson | 366/150 |
| 4,112,174 | 9/1978 | Hannes | 428/220 |
| 4,180,155 | 12/1979 | Stevick | 198/498 |

FOREIGN PATENT DOCUMENTS

| | | |
|---|---|---|
| 2717085 | 11/1977 | Fed. Rep. of Germany . |
| 543568 | 1/1977 | U.S.S.R. . |
| 549387 | 3/1977 | U.S.S.R. . |

*Primary Examiner*—Robert W. Jenkins

*Attorney, Agent, or Firm*—Robert M. Krone; Joseph J. Kelly; Richard K. Thomson

[57] ABSTRACT

This invention relates to a feeder 10 for glass fibers useful in feeding glass fibers to a wet-mat process. Previous fiber feeders were unreliable and caused process disruptions primarily due to fiber conveying belt breakage. Belt breakage in the present fiber feeder is substantially eliminated by providing a belt pulley comprising an open-ended cylindrical drum 52 having a plurality of staggered waste fiber intake openings 54 longitudinally and circumferentially distributed over the drum. The intake openings 54 are staggered and sized to eliminate interference with the motion of slats 60 which comprise the fiber conveying belt 50, to ensure sufficient flow of waste fiber 36' out of the drum 52 and to eliminate any potential accumulation of waste fiber 36' between the belt 50 and the belt pulley 48.

3 Claims, 5 Drawing Figures

FIBER FEEDER PULLEY CLEANING SYSTEM

TECHNICAL FIELD

This invention relates to a dispenser for fibrous material and more particularly to a waste removal pulley for a feeder useful in a process for making fibrous glass mat.

BACKGROUND OF THE PRIOR ART

It is well known, as typified by U.S. Pat. No. 4,112,174, to manufacture fibrous mats by forming an aqueous slurry including, e.g., glass fibers, in a plurality of tanks in which the fibers are intensely agitated in order to disperse the fibers. After this dispersing operation, the fiber containing slurry is applied to a moving screen where a vacuum may remove a majority of the water resulting in a fibrous mat or a web. After formation of the web, a binder substance may be applied to assist in an interbonding of the fibers. Thereafter, the bonded web is passed through a dryer for evaporating any water remaining in the web and for curing the binder.

Conventionally, in the above process, termed the "wet-mat" process, the glass fibers or fibrous material are fed or dispensed into the fiber dispersing tanks by a feeder comprising a pivotable bulk container which dumps the fibrous material onto a forward feed conveyor. A plurality of spike rolls agitate the material as it is conveyed by the forward feed conveyor to a pair of lift aprons. The lift aprons, along with a lower feed conveyor, define a fiber holding chamber so that upon command fibers can be transported to an incline conveyor and a fiber weighing scale. Subsequently, the fibers are allowed to fall by gravity from the scale into the fiber dispersing tanks.

The lift aprons of the above feeder comprise a tined, slatted belt trained about a driving and a driven pulley. During the operation of the feeder, fibers, i.e., waste fibers, are trapped and accumulated between the belt and the driven pulley resulting in an undesirable pattern of belt breakage and machine down time. As a result, maintenance costs are uneconomically high and the entire process continuity and dependability suffers.

BRIEF SUMMARY OF INVENTION

An object of the invention is to provide a waste removal pulley for a fiber feeder which reduces maintenance costs, down time and increases reliability.

The present invention provides a waste removal pulley which eliminates the afore-mentioned problems for a feeder for fibrous materials comprising a means for supplying fibrous material to the feeder. A forward feed conveyor receives and transports the material to a first lift apron while a means for agitating the material ensures that the fibrous material does not agglomerate. A slatted, tined belt is trained over a plurality of pulleys allowing the belt to lift fibrous material. One of the pulleys comprises an open-ended cylindrical drum whose exterior surface is provided with a plurality of intake openings. The openings are staggered along the circumference of the drum and are sized to ensure non-interference with the motion of the slats of the belt and proper flow of waste fibrous material through the drum. A conveying means for carrying waste fibrous material out of the drum and a means for conveying the fibrous material from the feeder are also provided.

BRIEF DESCRIPTION OF THE DRAWINGS

FIG. 3 illustrates a side view of a pulley of the present invention without the belt.

DETAILED DESCRIPTION OF THE INVENTION

Figures 1, 2:
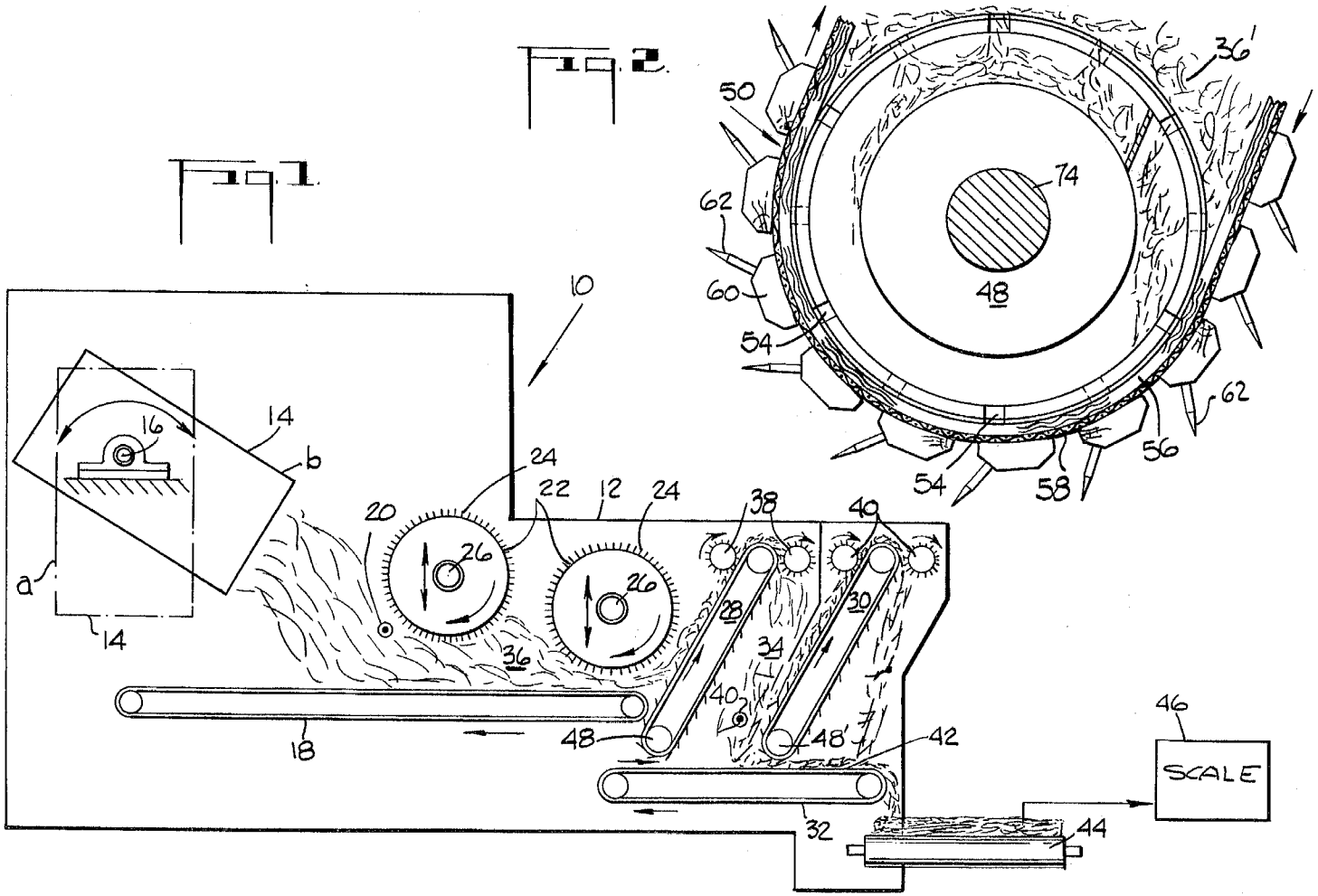
FIG. 1 is a schematic side view of the improved fiber feeder of the present invention.
FIG. 2 shows the relationship between a tined, slatted lift apron belt and a pulley of the present invention.

Referring now to the figures wherein like numerals refer to the same element and more particularly to FIG. 1 wherein a fiber feeder 10 exemplifying the present invention is illustrated. The feeder 10 comprises an enclosure 12 containing a fiber bulk container 14 which is pivotable about an axis 16 from a fill position, "a", shown in phantom to a dump position, "b", shown by the solid lines.

The container 14 receives fibrous materials, such as glass fibers, from a source (not shown) and upon a dump command, pivots from the position "a" to the position "b", thereby distributing fibers onto a variable speed forward feed conveyor 18. A conventional sonic sensor 20 measures fiber volume and supplies the dump command to the bulk container 14 to ensure a sufficient volume of fiber distribution on the conveyor 18.

A pair of vertically adjustable spike or hold-back rolls 22 agitate the fibers being conveyed (from left to right, as shown in FIG. 1). The rolls 22 are provided with a plurality of spikes 24 and are rotatably driven about their axes 26 (by a controllable means, not shown) in order to separate the fibers, prevent agglomeration of the fibers and provide a control on the mass flow rate of the fibers in addition to the capability of modifying the conveying speed of the conveyor 18.

The forward feed conveyor 18 thus transports a mass of individual fibers 36 to a first one of two lift aprons 28 and 30. The two lift aprons, in conjunction with a lower feed conveyor 32, define a fiber holding chamber 34. The fibers 36 are carried by the conveyor 18 to the first lift apron 28 whereupon the apron 28 lifts and carries the fibers past a pair of driven, spiked lumper and doffer rolls 38 which further agitate and separate the fibers. The apron 28 eventually deposits the fibers 36 into the chamber 34. A conventional sonic sensor 40, sensitive to the presence of the fibers 36, controls the motion of the apron 28 to ensure that a sufficient quantity of fibers is always present in the chamber 34.

Upon need of additional fibers to be fed to a downstream process (not shown) which could be a dispersing tank of a wet-mat process of the type briefly described earlier, a feed signal is generated by a source (not shown) and transmitted to the second of the two lift aprons 30 and to the conveyor 32. Upon receipt of the feed signal, the apron 30 and the conveyor 32 are set into motion. The apron 30 lifts fibers from the chamber 34, carries the fibers past another pair of driven, spiked lumper and doffer rolls 40 and deposits the fibers 36 onto a trailing portion 42 of the conveyor 32.

The fibers 36 subsequently fall off the portion 42 onto a conveyor 44 which conveys the fibers to a scale 46. The fibers are weighed on the scale 46 before being deposited within the dispersing tanks (not shown) mentioned earlier.

The lower portion of one of the lift aprons 28 or 30 is illustrated in FIG. 2 and is shown to comprise a pulley 48 and a conventional tined, slatted belt 50. As can be seen, in use, waste fibers 36' tend to collect between the pulley 48 and the belt 50. In the past, these fibers would accumulate to such an extent that undue pressure would be imposed on the belt 50 causing belt breakage. As a result of frequent belt breakage, the fiber feeder 10 required costly maintenance and was characterized as unreliable. Furthermore, the apparatus and process downstream of the feeder suffered costly disruptions and was unable to consistently produce a uniform product.

To eliminate belt breakage, the present invention provides for the feeder 10, as shown in FIG. 3, a pulley 48 comprising a cylindrical open-ended drum 52. The entire outer surface of the drum 52 is provided with a plurality of elongated, fibrous waste material intake openings 54 which are staggered in rows extending longitudinally over and circumferentially around the drum 52. The openings 54 are staggered and sized in order not to interfere with the motion of the belt 50, as will be better understood shortly.

As can be seen from FIG. 2, the belt 50 comprises an elastomer backing 56, a fabric carrier 58, a plurality of slats 60 and a plurality of tines 62. The tines 62 are appropriately mounted in a staggered fashion on the slats 60 and the slats 60 are mounted upon the backing 56 and the carrier 58 by means such as a plurality of rivets (not shown).

In use, the tines 62 of the apron 28, for example, pick up the fibers 36 from the conveyor 18 and convey the fibers to the chamber 34. However, it is important, in use, that the slats 60 are not interfered with by the openings 54. If the openings 54 are equal or larger in size and shape to the slats 60, the openings 54 may interfere with the motion of the slats 60. Furthermore, if the openings 54 are equal or larger in size and shape to the slats 60 certain distributions or arrangements of the openings may allow the moving slats to be forced into the openings thereby interfering with the motion of the belt 50. If the openings 54 are too small, it is possible that a gradual or even a rapid accumulation of waste fibers may take place which increases the likelihood of belt breakage. The openings 54 must consequently be properly sized to ensure that a sufficient flow of waste fibers 36' pass through the intake openings 54 and out of the drum 52 of the pulley 48. Staggering and proper sizing of the openings 54 is therefore extremely desirable.

Figures 4, 5:
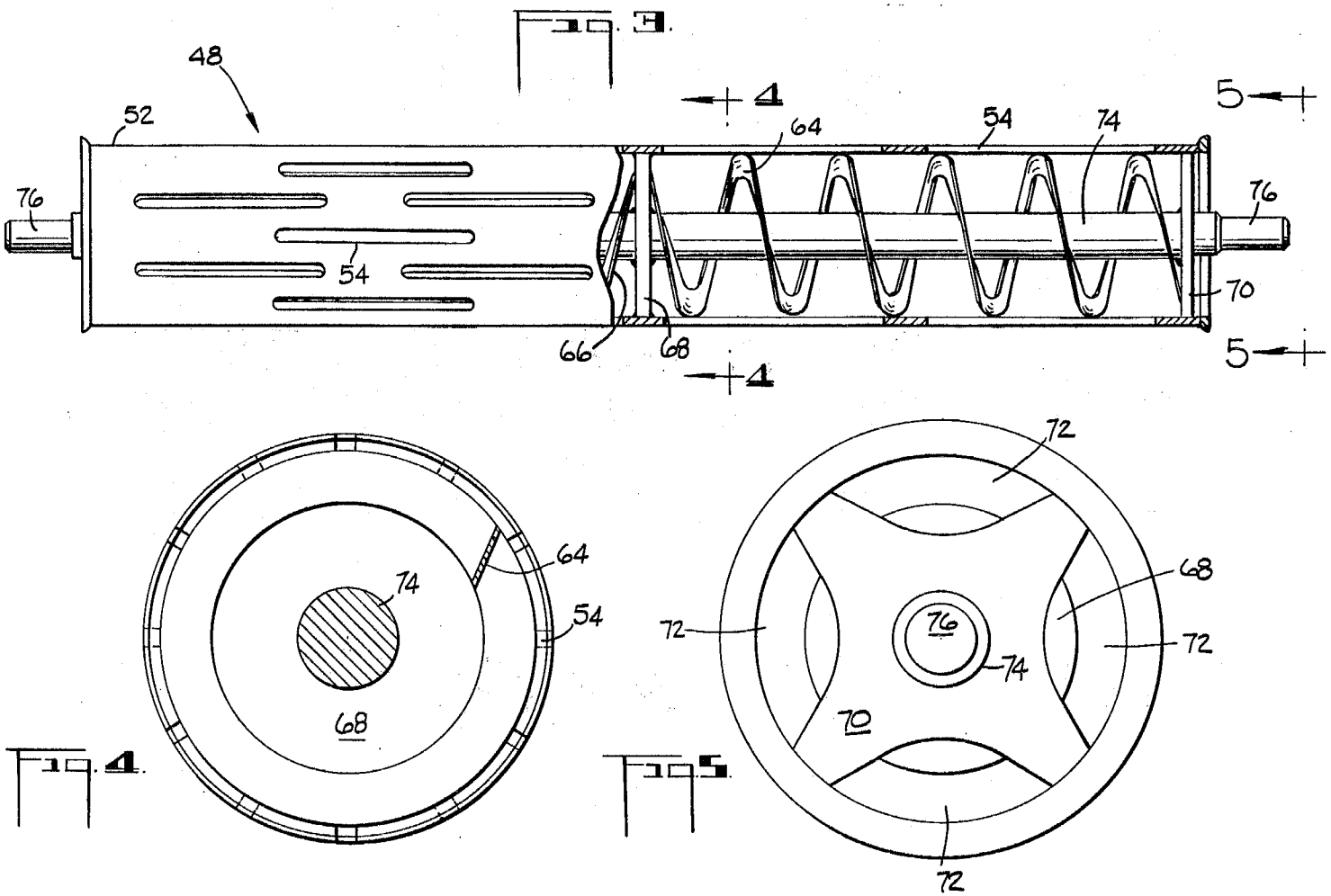
FIG. 4 is a view taken along lines 4—4 of FIG. 3.
FIG. 5 depicts a side view taken along lines 5—5 in FIG. 3.

In conjunction with the staggered and properly sized intake openings 54, the drum 52 is provided with two helical oppositely turned screw conveyors 64 and 66 which are configured to cause the waste fibers 36' to be conveyed to opposite ends of the open-ended drum 52. As shown in FIGS. 3–5, the conveyors 64 and 66 are supported at one end by a central partition plate 68 and at the exit ends of the drum by a pair of strut plates 70 which provide a plurality of discharge openings 72. A shaft 74, which passes through and is suitably attached to the plates 68, 70, provides a rotatable support for the pulley 48 and is itself supported by shaft endings 76. The shaft endings 76 are suitably attached to support bearings (not shown).

In use, waste fibers 36' pass through the openings 54 and are conveyed by the conveyors 64 or 65 to either side of the pulley 48 whereupon the fibers fall by gravity into suitable receptacles (not shown). The fibers 36' may either be disposed of or recycled back into the feeder 10 by an appropriate means (not shown).

In practice, it has been found to be more critical to use a pulley 48 for the lower or driven pulley of the first lift apron 28. However, the present invention is equally applicable to a driving pulley which is used in conjunction with a slatted conveyor belt. Additionally, the lower driven pulley 48' of the second lift apron 30 may be provided with a pulley of the present invention.

It is to be appreciated that various modifications to the inventive concept may be apparent to those skilled in the art without departing from the scope of the invention.

What is claimed is and desired to be secured by Letters Patent of the United States is:

1. In a feeder for fibrous material, comprising means for supplying fibrous material to said feeder, a forward feed conveyor, means for distributing said material onto said forward conveyor, means for agitating said material as it is being transported by said forward conveyor, a first lift apron for receiving fibrous material from said forward conveyor, said first lift apron being provided with a plurality of pulleys, a conveyor belt being trained for movement around said pulleys, said belt comprising a plurality of slats, a plurality of tines fixedly supported upon each of said slats and means for conveying said fibrous material from said feeder, the improvement comprising:

at least one of said pulleys comprising an open-ended cylindrical drum, a plurality of waste fibrous material intake openings extending through the exterior surface of said drum, said openings being staggered along the circumference of said drum and being sized to ensure noninterference with the motion of said slats and proper flow of waste material into said drum; and means for conveying said waste material from said drum.

2. In the feeder of claim 1, said waste material conveying means comprises:

a central partition plate fixed within said drum, a pair of strut plate having a plurality of waste material discharge openings, one of said strut plate being mounted at each end of said drum;

a pair of worm conveyors fixed within said drum, one end of each worm conveyor being fixed to said partition plate, the other end of each worm conveyor being fixed to one of said strut plates.

3. In the feeder of claim 2, said worm conveyors comprise:

the turns of one worm conveyor is opposite to the turns of the other worm conveyor whereby waste material may be conveyed to each end of said drum.

* * * * *